US005154776A

United States Patent [19]

Bloch

[11] Patent Number: 5,154,776

[45] Date of Patent: Oct. 13, 1992

[54] METHOD FOR DECONTAMINATION OF VESSELS AND OTHER EQUIPMENT POLLUTED WITH METALLIC SODIUM AND OTHER REACTIVE METALS

[76] Inventor: Christopher J. Bloch, 2919 Redwood Lodge, Kingwood, Tex. 77339

[21] Appl. No.: 711,184

[22] Filed: Jun. 5, 1991

Related U.S. Application Data

[63] Continuation of Ser. No. 353,973, May 18, 1989, abandoned.

[51] Int. Cl.[5] ..... B08B 3/08; B08B 3/10; B08B 9/08

[52] U.S. Cl. ..... 134/22.1; 134/10; 134/11; 134/18; 134/22.19; 134/25.1; 134/25.4; 134/39; 134/40; 134/41; 134/42

[58] Field of Search ..... 134/10, 11, 18, 22.19, 134/25.1, 25.4, 39, 40, 41, 42, 22.1

[56] References Cited

U.S. PATENT DOCUMENTS 4,666,528 5/1987 Arrington et al. ..... 134/41

4,908,137 3/1990 Chen et al. ..... 210/679

*Primary Examiner*—Theodore Morris
*Assistant Examiner*—Zeinab El-Arini
*Attorney, Agent, or Firm*—Gunn, Lee & Miller

[57] ABSTRACT

The present disclosure is directed to a method and apparatus for removing sludge and reactive metallic deposits, primarily sodium, from a reaction vessel. The process involves circulating under an inert atmosphere a solvent which covers the reactive metal and which solvent removes sludge and other sediments in the vessel including greases, processed salts, etc. Preferably, the process is carried out at a slightly elevated temperature perhaps 120° F. or more. Water or primary alcohols or a mix is added ratably to react with the reactive metal until it is completely removed. The discharge temperature is permitted to increase to perhaps 190° F. and is preferably kept below 245° F. to assure relatively easy handling of the solvent discharge. Recirculation is continued after cooling, sparging, settling to remove impurities picked up in the vessel and recirculation. An apparatus is also disclosed.

13 Claims, 1 Drawing Sheet

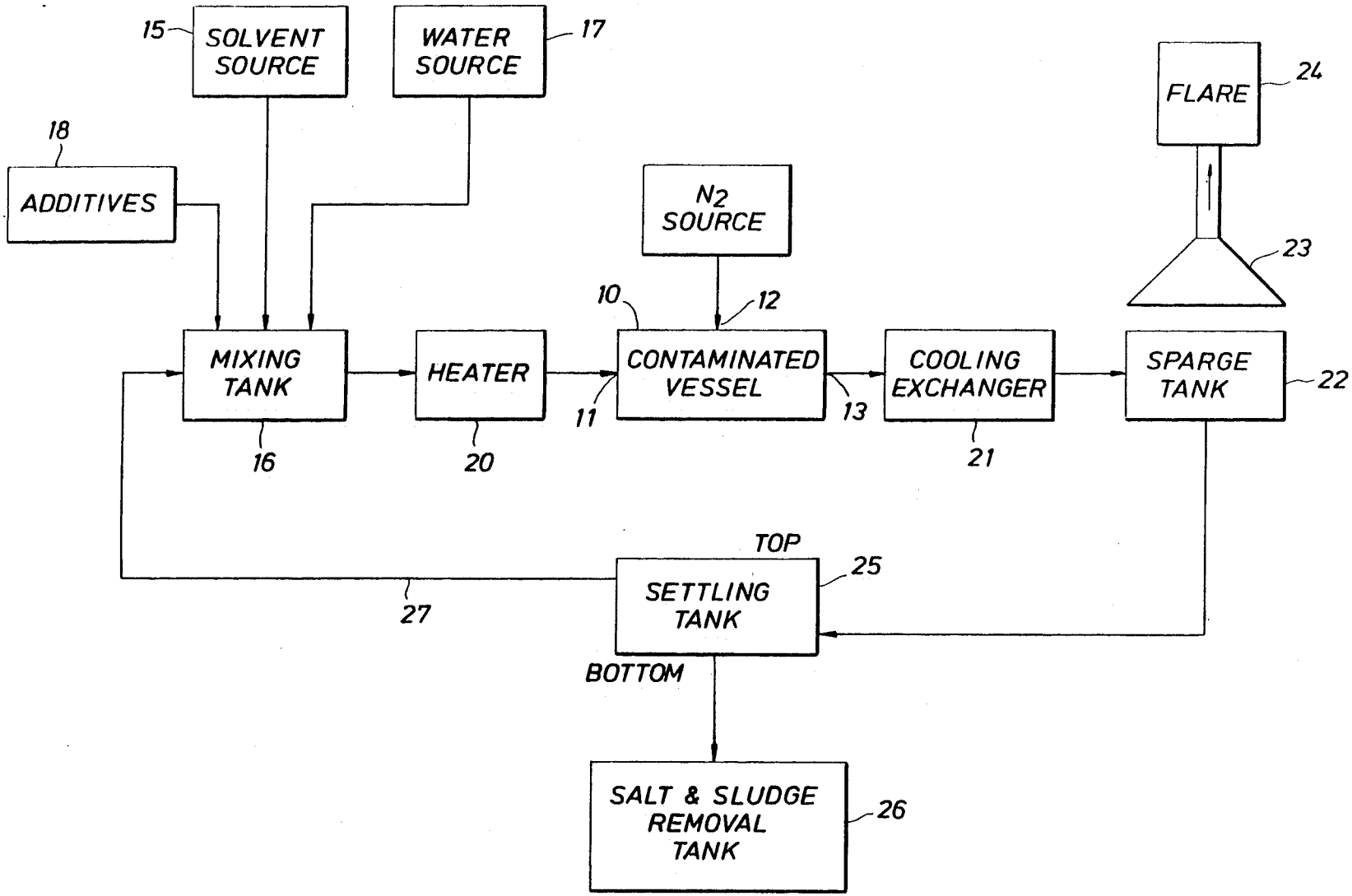
FLARE
24
23
SPARGE TANK
22
COOLING EXCHANGER
21
13
CONTAMINATED VESSEL
10
11
N2 SOURCE
12
TOP
SETTLING TANK
25
BOTTOM
SALT & SLUDGE REMOVAL TANK
26
27
HEATER
20
MIXING TANK
16
WATER SOURCE
17
SOLVENT SOURCE
15
ADDITIVES
18

METHOD FOR DECONTAMINATION OF VESSELS AND OTHER EQUIPMENT POLLUTED WITH METALLIC SODIUM AND OTHER REACTIVE METALS

This is a continuation of application Ser. No. 07/353,973 filed May 18, 1989, now abandoned.

BACKGROUND OF THE DISCLOSURE

The present invention is directed to a method and apparatus for interior cleaning of pipes, vessels, and other equipments which are contaminated with metallic sodium or other highly reactive chemical constituents. Typically, such contamination includes process related greases, sludges, and other materials. This process features the introduction of a non-reactive carrier solvent which is formulated to contain a small percentage of water. The carrier solvent and water combination (either a solution or emulsion) have solvent properties which will dissolve or disperse salts, oils, greases and other contaminants which might otherwise coat over the reactive metals and prevent access of the wet solvent to the underlying metallic sodium. Metallic sodium is exposed to react with the water in the solvent to generate sodium hydroxide and hydrogen. The heat released by this reaction and the reaction products are removed from the vessel, piping, or equipment being cleaned by the circulating solvent. The process related sludges are stripped and carried away by the solvent.

BACKGROUND DESCRIPTION

The interior walls of vessels, piping, and equipment used to store, transport, and process metallic sodium often become contaminated with resident amounts of metallic sodium. Metallic sodium is a solid at temperatures below its melting point at 208° F. Any cool surfaces in a system handling molten metallic sodium will accumulate sodium residuals. Sodium is highly reactive and will oxidize if exposed to air to form sodium oxides. Moisture found on surfaces or contained in the air will also react with sodium to form sodium hydroxide and hydrogen. In an effort to minimize the exposure of sodium to air and water, sodium is often stored in high boiling hydrocarbons such as mineral oil, kerosene, xylene, and toluene. Residuals of these hydrocarbons are also frequent constituents of the contamination found in storage vessels, piping, and process equipment.

Sodium is reacted with alcohols, ammonia, alkyl halides, aryl halides, lead with ethyl chloride, alkyl dihulides, naphthalene and many other industrial chemistries to form many useful products. These reaction products can also become a constituent of the contamination found on the surfaces of storage vessels, piping, and process equipment.

In addition to the above, sodium also contains quantities of potassium, calcium, and their salts which also become constituents of the fouling deposits found in storage vessels, piping, and process equipment.

The storage vessels, piping, and process equipment so contaminated may in time become so fouled with these contaminants that the flow passages become plugged. Storage vessels and process equipment may accumulate sufficient quantities of contaminants as to make them unusable for their intended purpose. Should this happen, it becomes necessary to periodically clean the storage vessels, piping, and process equipment. Cleaning will also be required periodically to allow inspection, testing, repair, or modification of the contaminated equipment. Cleaning is also required for equipment which is no longer needed to allow for safe disposal.

In the past, this cleaning has been typically performed by first purging the equipment with an inert gas such as nitrogen or argon. The vessel or chamber is then carefully entered by personnel wearing protective clothing and respiratory protection. As some sodium residues are highly pyrophoric, great care must be taken to prevent air or moisture from entering the equipment.

Sodium residues are removed by scraping or chopping the sodium and sludge contaminants from the surfaces. Air hammers are used in certain cases to remove the residuals. This cleaning process is inherently dangerous, time consuming, and expensive. Due to the inaccessibility of all surfaces to mechanical cleaning, much sodium is often left behind at locations not easily cleaned.

As an alternate cleaning process, sodium may also be reacted by purging the process equipment with dry air to burn the sodium, mixtures of nitrogen and steam may purge the sodium by reacting with it. Alternatively, an open flame may be directed against the residual sodium and its sludge contaminants in an attempt to burn off the sodium. In most cases some combination of these methods are used to decontaminate and refurbish the equipment.

In many cases it is difficult to completely remove all sodium due to the masking effect of the particular mixture of contaminants (hereinafter "sludge") present in spite of the best efforts of those performing the cleaning operation. It is also often difficult to avoid the release of sodium oxides to the environment or to contain the sodium hydroxide formed as a reaction product.

SUMMARY OF THE INVENTION

Sodium is a typical metal from Group 1A which is not ordinarily found in nature in the pure state; it is normally so active that it is not found in the pure state. It accumulates in process vessels in the manner described in this disclosure by collecting on the walls sealed beneath the sludge thereabove so that it does not interact with the elemental oxygen in the atmosphere. Sodium is observed to be in Group 1A of the periodic table. It is more common than potassium or lithium which are also in Group 1A and which also have the same tendency as highly reactive, nearly explosive metals covered by the layer of sludge.

One object of the present invention to provide an improved method for cleaning storage vessels, piping, and process equipment to remove metallic sodium and the related sludge contaminants which may be found with it.

This method involves the circulation of a non-reactive solvent formulated to contain water, alcohols, or other reactants to be used to convert the metallic sodium to a less reactive salt. This solvent formulation may also contain agents which will dissolve or disperse the hydrocarbon sludge contaminants, sodium reaction products and other contaminants found with the sodium.

In one embodiment, the non-reactive solvent is ethylene diamine. This solvent is mixed with a water concentration of from one to ten percent. Dispersants, foaming agents, and emulsifiers can be added as appropriate. The solvent is circulated throughout the system to be cleaned. Water is added slowly over time. The heat generated from the sodium reaction with the water heats the solvent to an elevated temperature from 150° F. to 190° F. The temperature is optionally permitted to go to solvent boiling temperature; the vapors are condensed and recovered. The temperature of the reactive system is moderated by the heat capacity of the solvent and the heat of the vaporization as the ethylene diamine approaches its boiling point of 245° F. This heat in turn is removed from the circulating system by means of an external heat exchanger.

The hydrogen liberated by the reaction of the water with the metallic sodium is swept from the system by purge nitrogen introduced to the vessel being cleaned. In addition to purging highly flammable hydrogen from the system, the nitrogen has the effect of reducing the partial pressure of the ethylene diamine. As a result, more ethylene diamine evaporates at the reaction sites at lower temperatures, thus removing more heat from the system.

Sludge contaminant salts and the salts of sodium and its hydroxide formed by the reaction of the sodium with water are soluble in the heated water containing solvent. Additional water is ratably added as water is consumed by reaction with the sodium.

It is a unique feature of this system that although many oils and water are completely miscible with the solvent, that both oil rich and salt rich phases will separate from the wet solvent when the solvent is cooled and allowed to settle. This feature allows the oil and salt contaminants to be removed from the system without consumption of excess amounts of the ethylene diamine.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single view is a flow chart showing a decontamination system for use with a contaminated vessel for removal of metallic sodium and process related sludges therein wherein a solid circulation system is illustrated.

DETAILED DESCRIPTION OF THE PREFERRED EMBODIMENT

One goal of the present invention is the cleaning of process equipment successfully by means of a wet solvent wash. As an example of this process, consider the following representative problem. A vessel containing approximately 1200 pounds of contaminated metallic sodium is no longer usable for its intended purpose in a chemical plant. If the vessel is quite large, prior approaches have involved purging the vessel with nitrogen, careful exclusion of all oxygen and water, and entry by specially equipped and specially trained personnel primarily engaging in hand removal of the sludge and metallic coating on the interior of the vessel. Small vessels present much more difficult problems. They can be sufficiently small that internal working space is limited, perhaps nonexistent. Alternately, a process vessel may include certain regions where easy access can be obtained; other regions of the vessel may be very difficult to access because of size; in some vessels, the metallic sodium coating may be hidden in small pipes, valves, adjacent to flanges, etc.

Assume that dimensions and the lack of adequate access prohibit effectual manual entry and cleaning. The cleaning skid described below is connected by pipe to the vessel to allow circulation of the solvent. The solvent is introduced to the vessel at 120° F. with a water content of five percent. The subsequent reaction of the sodium with the water raises the solvent temperature to about 170° F. or more. Nitrogen is purged into the vessel being cleaned. The exhaust solvent (in liquid or gas form) is cooled by means of a cooler. Condensed and recovered solvent is collected to settle salts and sludge and then returned to the system. The exhaust gases are piped to a flare at which any hydrogen and hydrocarbon fumes are burned. Higher temperatures are permitted as described below.

In the single drawing, the contaminated vessel to be cleaned is identified by the numeral 10. All of the remaining equipment shown in the drawing can ideally be mounted on a single skid for easy installation adjacent to the contaminated vessel. The vessel can have any size ranging from holding just a few hundred gallons of solvent to a vessel holding several thousand gallons of solvent. In any event, the contaminated vessel is closed off at all points to exclude the intrusion of oxygen and water. It is closed off and solvent flow points are selected at 11 and 13. The point 11 is particularly selected so that it is remote and across the contaminated vessel from the exit point 13. This assures that the flow of the solvent carries the solvent to all portions of the vessel. Moreover, this assures complete cleaning of the vessel. In addition to that, there might be air pockets in the vessel. To this end, attempts are made to bleed off all air and to fill the vessel by introducing dry nitrogen at the inlet 12. To the extent that the vessel has leakage, the nitrogen flow is continuous to keep the inert cushion over the solvent and to assure that processing occurs under the appropriate inert atmosphere. Whatever the size and shape, the contaminated vessel is thus isolated and is provided with the solvent inlet 11 and the solvent exit 13. The gas inlet port 12 is also determined and connected.

The apparatus of the present disclosure defines a closed loop flow path which reclaims the relatively expensive solvent. Perhaps the best approach in describing this flow path is to begin with the solvent source 15. A sufficient supply of solvent for the vessel 10 (for example, one or more rail cars of solvent) is obtained. While the solvent source might be quite large, it is ratably input to a relatively small mixing tank 16. There is a water source 17 which is also input to the mixing tank. Suitable additives are provided in appropriate containers 18, and they are introduced at metered rates into the mixing tank 16. The solvent is preferably the above-identified ethylene diamine. The preferable solvent is one which will not react with sodium, which provides a complete cover to any sodium, thereby excluding water and oxygen from contact with the sodium except as permitted by introduction of water. The solvent preferably boils above the boiling point of water and is a fairly universal grease solvent. The preferred solvent is described below. The preferred range of water introduction is something less than 10 percent. The water should be added at a rate sufficient to raise the temperature as described below. Temperature monitoring is a good indication of the rate at which the sodium is being removed. Accordingly, temperature increase is measured and kept within desired limits. This temperature increase is a direct result of the reaction of water with sodium. This exothermic reaction will heat the solvent and consume the water. To this end, it is appropriate to therefore measure the temperature sustained in the vessel 10, typically by measuring the outlet temperature. Operation is preferably below 245° F. It is also desirable to measure the rate at which water is added. Ultimately, the temperature will start falling which indicates generally that very little sodium remains to be consumed, and it will ultimately drop back to the inlet temperature of the solvent introduced into the vessel because all of the sodium has been consumed. At this point, the subsequent addition of any water is meaningless.

Water is supplied at a controlled rate as mentioned above and which is increased to obtain the desired maximum temperature. The minimum rate of water is tied to the slowness of the process which is a scale factor dependent on the amount of sodium to be removed. It is desirable to operate near the maximum rate of water permitted so long as the temperature does not elevate above a desired level such as 245° F. In addition, additives are metered into the mixture and such additives can include dispersants, defoamers, emulsifiers and the like to improve wettability for removal of the sludge found in the vessel 10.

The nature of the sludge is highly variant and depends primarily on the nature of the process conducted in the vessel. The sludge is typically process related residual materials. Typically, the sludge will form a type of protective coating over the metallic sodium in the tank. As an example, when the process is operative in the vessel, all the constituents are typically in a molten state and able to flow. However, the sludge will coat out on or in stratified layers with the sodium. In some instances, the sludge and sodium will form a kind of mixture; the precise definition of the sludge and the form in which it coats the solid metallic sodium is highly variant dependent on a number of factors including the nature of the process conducted in the vessel, the manner in which the vessel is cooled, the manner in which coating occurs, and other factors of the same general nature. Moreover, the process vessel 10 ultimately becomes less than efficient, perhaps even unusable, and must at that time be cleaned. Accordingly, the term "sludge" has been chosen to describe those materials, and is a generalized term referring to the nonmetallic materials and especially those which serve as a kind of protective coating which defeats easy access to the metallic coating in the vessel. The term "solvent" refers to the preferred material which has desirable characteristics including substantial heat capacity, a boiling point which is low enough to enable heat transfer by boiling, and also is a good grease cutting solvent. Also, the solvent protects the explosive pure metal to exclude oxygen and prevent fires.

After passing through the mixing tank, the solvent and water mixture is then introduced into a heater 20 and the temperature is raised to an elevated temperature. Approximately 120° F. is desirable although tight control of the temperature is not critical. The water and solvent mixture is introduced into the vessel at a suitable elevated pressure to flow through the vessel 10. For sake of clarity, the various pumps and valves associated with this flow path have been omitted; as will be understood, suitable valves and pumps are included to provide flow control as appropriate. The heated solvent thus circulates through the vessel and exits the vessel to the cooling exchanger 21. There, the solvent is cooled. There is the possibility that the solvent may arrive at the cooling exchanger as a mixture of solvent fumes with liquid. This depends in part on the boiling point of the solvent, the partial pressure of the solvent, the incremental heat input to the solvent and the discharge temperature. In any case, whether the discharge is in either phase or a mixture, it is discharged to the cooling exchanger and the temperature is dropped substantially. The temperature after cooling is important to removal of the salts and sludge carried in the solvent, that being discussed below. In any event, the process which occurs in the vessel reacts the highly dangerous metallic sodium with small quantities of water to liberate hydrogen. The hydrogen will tend to escape from the vessel 10 if there is an escape route. It is better to seal the vessel at least to the extent possible. This carries the hydrogen through the cooling exchanger where it is delivered to a sparge tank 22. The hydrogen escapes, and is preferably captured along with any hydrocarbon fumes and directed through a vent 23 and then is delivered to a flare 24. The solvent, now having been cooled, is delivered to a settling tank 25. At certain temperatures, the solvent will carry the salt and sludge in solution. If cooled, they tend to settle out more readily. In any event, salt is added to the solvent as a result of the conversion of sodium and the reaction with the various sludges. Sludges can include all types of grease and other hydrocarbon products; in addition to that, the sludge may well contain inorganic salts. In any event, various and sundry salts may be carried out of the vessel 10. In addition, the solvent will typically cut various greases and the like which make up the sludge and will remove that also. In the settling tank, with cooling, there is a tendency for the salts and sludge in the discharged flow from the vessel 10 to settle. They are removed from the bottom of the settling tank to a salt and sludge removal tank 26. This typically is accomplished by permitting stratification in the settling tank, and periodically draining the bottom of the tank. It is illustrated in the drawing as having a top and bottom. The bottoms are removed to the tank 26 while the reclaimed and cooled solvent is directed out of the tank 25 by a removal line connected at the top of the tank. The line 27 removes the solvent and returns it to the mixing tank for recycling. After the process begins, it may be necessary to periodically supply additional solvent. Water is added for the reasons mentioned above so that the process can continue to operate while recycling the solvent.

As a convenience, it may be appropriate to combine the sparge tank 22 and the settling tank 25. If so, the vent 23 is simply placed over the settling tank, and any gases obtained from the dirty solvent are then vented and burned as appropriate. On the other hand, the sediment in the solvent is permitted to collect at the bottom of the tank 25 and is removed as shown.

Solvent circulation and water addition are continued until testing indicated that water is not being consumed and no more heat from the reaction of metallic sodium observed.

In some instances, the solvent may dissolve a particular grease or other sludge constituent, carry that along and simply recycle it time and again through the dirty vessel 10. There may be a sludge constituent that does not settle to the bottom for easy removal. Generally, such dissolved sludge constituents can be continuously circulated so long as the solvent continues to accomplish sludge and sodium removal.

The present process is equally effective with other metallic coatings of the same general nature. For instance, and substantially dependent on the purity of the feedstock supplied to the process and the very nature of the process carried on in the vessel, the coatings in the vessel may include metals similar to sodium. In particular, metals such as potassium, lithium and phosphorus pose similar or the same problems. That is, all of these metals are highly reactive, are never found in the native state as pure metal, and can be handled only by exclusion of air and water. They tend to react with incendiary results if exposed air and water, and for that reason they are normally stored totally submerged in kerosene and other similar hydrocarbons as mentioned above. In any event, the reactive metals just mentioned are potentially intermingled with the sodium. Thus, it is possible that the coatings formed in the vessel are alloys of various reactive metals along with sodium.

The start up of the present process should be carefully considered. All of the equipment shown in the single drawing is preferably mounted on a single skid with appropriate hoses for connection with the dirty vessel 10. An initial flow of solvent is introduced into the vessel. The initial flow may have no water whatsoever; it may be appropriate to begin with no water and to otherwise fill the vessel 10 before the introduction of water. This is a safety precaution because there may be residual oxygen or water in the vessel. In any event, the initial solvent flow is introduced and the vessel is filled with solvent. Of course, all this is carried out in the presence of dry nitrogen which is introduced into the vessel to blanket the entire cleaning process. Indeed, the nitrogen can be added to the solvent flow so that it is bubbled into the solvent for introduction in that fashion, alternately, the nitrogen can be added at another point of entry. In any event, the interior of the vessel is blanketed with the solvent and nitrogen atmosphere. After circulating for an appropriate interval, some portions of the sludge may well be removed, thereby exposing the previously coated sodium deposits. At this juncture substantial degreasing may have occurred and process related sludge salts may also be dissolved and removed. In any case, the addition of water is initiated. Sodium conversion is measured by the change in temperature of the fluid discharged from the vessel 10. That continues for an interval while the rate of addition of water is increased subject to the limitations of some maximum established temperature. That is a scale factor which is best adjusted on site. In part it depends on the dwell time which is approximately related to the volumetric capacity of the vessel divided by the rate of introduction of solvent. In addition, it depends on the rate at which they sludge is stripped away to expose the metal deposits for conversion on reaction with the water. In any case, water is added and the discharge temperature is observed. The optimal mode of operation is the addition of sufficient water to raise the temperature at the vessel discharge to about 190° F. Raising the temperature higher may speed up the process of cleaning, but it also may tend to boil off some of the water. In any event, the discharged solvent including water, both being in the liquid and gas phases is discharged and cooled for gas condensation, and of course, the solvent is recycled.

As the discharge temperature drops and thereby indicates exhaustion of the available sodium, continual monitoring will suggest the time at which the process should be shut down. If the temperature drop continues, even after increase in the water concentration, it is a useful indication that the available sodium in the vessel has been converted. In some instances, it is desirable to use only water as the metal reactant, but in other instances, primary alcohols, or a mix with water, will serve as a satisfactory reactant. The reactant metal products can be controlled by choice of reactant, or mix of reactants.

When the process has been completed, the vessel 10 is drained, and the equipment is disconnected. All the equipment shown in the single drawing can be readily mounted on a common skid for easy transport to another location.

While the foregoing is directed to the preferred embodiment, the scope is determined by the claims which follow.

What is claimed is:

1. A method of cleaning a contaminated process vessel to remove deposits of sodium along with the process related sludges, the method of comprising the steps of:

(a) circulating an organic solvent primarily of ethylene diamine through the process vessel wherein the solvent covers the deposits to prevent the sodium from reacting with oxygen or water wherein oxygen and water are excluded from contact with the sodium;

(b) adding an amount of reactant to the solvent wherein the amount is sufficient to react with the sodium in the vessel after protective sludges over the sodium have been at least partially removed to expose the sodium to the reactant in the solvent, and raising the temperature of the circulating solvent with heat liberated from reaction of the reactant with the sodium;

(c) removing a flow of solvent from the vessel to carry from the vessel process related sludge constituents dissolved in the solvent and additionally the reaction products formed by the reactant and sodium occurring in the vessel; and (d) continuing the circulation of solvent and reactant until the vessel has been cleaned by sludge and sodium removal.

2. The method of claim 1 including the step of delivering a flow of inert gas to the vessel to provide an internal inert atmosphere within the vessel.

3. The method of claim 1 further including the preliminary step of heating the solvent to a temperature above ambient but not in excess of about 245° F., circulating the heated solvent into the vessel, and monitoring the solvent discharge temperature from the vessel to observe the temperature increase as an indication of removal of the metal from the vessel.

4. The method of claim 3 including the step of post vessel treatment of the discharged solvent by cooling.

5. The method of claim 3 including the step of post vessel treatment of the discharged solvent by sparging.

6. The method of claim 3 including the step of post vessel treatment of the discharged solvent by settling.

7. The method of claim 3 including the step of post vessel treatment of the discharged solvent by cooling and sparging.

8. The method of claim 3 including the step of post vessel treatment of the discharged solvent by cooling, sparging and settling.

9. The method of claim 8 wherein the solvent, after cooling, sparging and settling, is then recirculated through a heater for return to the vessel.

10. The method of claim 1 including the step of placing additives in the solvent to assist the process carried out in the vessel.

11. The method of claim 1 including the step of adding additives to the solvent prior to circulation in the vessel.

12. The method of claim 1 wherein the solvent is essentially ethylene diamine.

13. The method of claim 1 wherein the reactant is water or primary alcohol or a mix thereof.

* * * * *